US010018411B2

(12) United States Patent
Thiebault et al.

(10) Patent No.: US 10,018,411 B2
(45) **Date of Patent: *Jul. 10, 2018**

(54) SIMPLIFIED METHOD FOR PRODUCING A METHANE-RICH STREAM AND A $C_2^+$ HYDROCARBON-RICH FRACTION FROM A FEED NATURAL-GAS STREAM, AND ASSOCIATED FACILITY

(75) Inventors: Sandra Armelle Thiebault, Coye-la-Foret (FR); Vanessa Marie Stéphanie Gahier, Jouy le Moutíer (FR); Julie Anne Gouriou, Rueil Malmaison (FR); Loïc Pierre Roger Barthe, Paris (FR)

(73) Assignee: TECHNIP FRANCE (FR)

( * ) Notice: Subject to any disclaimer, the term of this patent is extended or adjusted under 35 U.S.C. 154(b) by 1010 days.

This patent is subject to a terminal disclaimer.

(21) Appl. No.: 13/879,743

(22) PCT Filed: Oct. 19, 2011

(86) PCT No.: PCT/FR2011/052439

§ 371 (c)(1),
(2), (4) Date: Jun. 5, 2013

(87) PCT Pub. No.: WO2012/052681

PCT Pub. Date: Apr. 26, 2012

(65) Prior Publication Data

US 2013/0255311 A1 Oct. 3, 2013

(30) Foreign Application Priority Data

Oct. 20, 2010 (FR) ..... 10 58573

(51) Int. Cl.
*F25J 3/02* (2006.01)

(52) U.S. Cl.
CPC ..... *F25J 3/0209* (2013.01); *F25J 3/0233* (2013.01); *F25J 3/0238* (2013.01); *F25J 3/0247* (2013.01);
(Continued)

(58) Field of Classification Search
CPC ..... F25J 3/0233; F25J 3/0238
See application file for complete search history.

(56) References Cited

U.S. PATENT DOCUMENTS 2,601,599 A 6/1952 Deming
3,213,631 A 10/1965 Kniel
(Continued)

OTHER PUBLICATIONS

International Search Report dated May 7, 2013 in corresponding International Application No. PCT/FR2011/052439.
(Continued)

*Primary Examiner* — Tareq Alosh
(74) *Attorney, Agent, or Firm* — Ostrolenk Faber LLP

(57) ABSTRACT

A method comprising the cooling of the feed natural-gas (15) in a first heat exchanger (16) and the introduction of the cooled feed natural-gas (40) in separator flask (18). The method further comprising dynamic expansion of a turbine input flow (46) in a first expansion turbine (22) and the introduction of the expanded flow (102) into a splitter column (26). This method includes sampling at the head of the splitter column (26) a methane-rich head stream (82) and sampling in the compressed methane-rich head stream (86) a first recirculation stream (88). The method comprises the formation of at least one second recirculation stream (96) obtained from the methane-rich head stream (82) downstream from the splitter column (26) and the formation of a dynamic expansion stream (100) from the second recirculation stream (96).

8 Claims, 8 Drawing Sheets

(52) U.S. Cl.
CPC ..... *F25J 2200/02* (2013.01); *F25J 2200/76* (2013.01); *F25J 2205/04* (2013.01); *F25J 2210/04* (2013.01); *F25J 2210/06* (2013.01); *F25J 2230/24* (2013.01); *F25J 2230/60* (2013.01); *F25J 2235/60* (2013.01); *F25J 2240/02* (2013.01); *F25J 2245/02* (2013.01); *F25J 2270/04* (2013.01); *F25J 2270/06* (2013.01); *F25J 2270/88* (2013.01); *F25J 2290/80* (2013.01)

(56) References Cited

U.S. PATENT DOCUMENTS 4,687,499 A * 8/1987 Aghili ..... C07C 7/005 62/621
5,600,969 A 2/1997 Low
6,578,379 B2 6/2003 Paradowski
8,752,401 B2 * 6/2014 Paradowski ..... F25J 3/0209 62/622
2004/0079107 A1 * 4/2004 Wilkinson ..... F25J 1/0239 62/611
2004/0159122 A1 8/2004 Patel et al.
2005/0247078 A1 * 11/2005 Wilkinson ..... F25J 1/0205 62/612
2006/0283207 A1 * 12/2006 Pitman ..... F25J 3/0209 62/620
2008/0190136 A1 8/2008 Pitman et al.
2009/0282865 A1 * 11/2009 Martinez ..... F25J 3/0209 62/620
2010/0263407 A1 * 10/2010 Paradowski ..... F25J 3/0209 62/621
2011/0005273 A1 * 1/2011 Gahier ..... F25J 3/0209 62/621
2014/0238075 A1 * 8/2014 Paradowski ..... F25J 3/0209 62/620

OTHER PUBLICATIONS

Loïc Barthe, et al., "Ethane Recovery Processes Evolve to Meet Market Needs," 24th World Gas Conference, Oct. 6, 2009, pp. 1-11.

* cited by examiner

SIMPLIFIED METHOD FOR PRODUCING A METHANE-RICH STREAM AND A $C_2^+$ HYDROCARBON-RICH FRACTION FROM A FEED NATURAL-GAS STREAM, AND ASSOCIATED FACILITY

CROSS-REFERENCE TO RELATED APPLICATIONS

The present application is a 35 U.S.C. § § 371 national phase conversion of PCT/FR2011/052439, filed Oct. 19, 2011, which claims priority of French Application No. 10 58573, filed Oct. 20, 2010, the contents of which are incorporated by reference herein. The PCT International Application was published in the French language.

BACKGROUND OF THE INVENTION

The present invention relates to a method for producing a methane-rich stream and a $C_2^+$ hydrocarbon-rich fraction from a dehydrated feed natural-gas stream, the method being of the type comprising the following steps:

- cooling the feed natural-gas stream advantageously at a pressure greater than 40 bars in a first heat exchanger, and introducing the cooled feed natural-gas stream into a separator flask;
- separating the cooled natural-gas stream in the separator flask and recovering an essentially gaseous light fraction and an essentially liquid heavy fraction;
- forming a turbine input flow from the light fraction;
- dynamically expanding the turbine input flow in a first expansion turbine and introducing the expanded flow into an intermediate portion of a splitter column;
- expanding the heavy fraction and introducing the heavy fraction into the splitter column, the heavy fraction recovered in the separator flask being introduced into the splitter column without passing through the first heat exchanger;
- recovering, at the bottom of the splitter column, a bottom $C_2^+$ hydrocarbon-rich stream intended to form the $C_2^+$ hydrocarbon-rich fraction;
- sampling at the head of the splitter column a methane-rich head stream;
- heating up the methane-rich head stream in a second heat exchanger and in the first heat exchanger and compressing this stream in at least one first compressor coupled with the first expansion turbine and in a second compressor for forming a methane-rich stream from the compressed methane-rich head stream;
- sampling in the methane-rich head stream a first recirculation stream; and
- passing the first recirculation stream into the first heat exchanger and into the second heat exchanger in order to cool it down, and then introducing at least one first portion of the first cooled recirculation stream into the upper portion of the splitter column.

Such a method is intended to be applied for building new units for producing a methane-rich stream and a $C_2^+$ hydrocarbon fraction from a feed natural-gas, or for modifying existing units, notably in the case when the feed natural-gas has a high ethane, propane and butane content.

Such a method also applies to the case when it is difficult to apply cooling of the feed natural-gas by means of an outer cooling cycle with propane, or to the case when the installation of such a cycle would be too expensive or too dangerous, such as for example in floating plants, or in urban regions.

Such a method is particularly advantageous when the unit for fractionating the $C_2^+$ hydrocarbon cut which produces the propane intended to be used in the cooling cycles is too far away from the unit for recovering this $C_2^+$ hydrocarbon fraction.

The separation of the $C_2^+$ hydrocarbon fraction from a natural gas extracted from the subsoil gives the possibility of satisfying both economic imperatives and technical imperatives.

Indeed, the $C_2^+$ hydrocarbon fraction recovered from natural gas is advantageously used for producing ethane and liquids which form raw materials in petrochemistry. Further, it is possible to produce from a $C_2^+$ hydrocarbon cut, $C_5^+$ hydrocarbon cuts which are used in oil refineries. All these products may be economically valued and contribute to the profitability of the facility.

Technically, the requirements of natural gas marketed in a network include, in certain cases, a specification at the level of the calorific value which has to be relatively low.

Methods for reducing $C_2^+$ hydrocarbon cuts generally comprise a distillation step, after cooling the feed natural-gas in order to form a methane-rich head stream and a $C_2^+$ hydrocarbon-rich bottom stream.

In order to improve the selectivity of the method, sampling a portion of the methane-rich stream produced at the head of the column after compression and reintroducing it after cooling into the column head are known for forming a reflux of this column. Such a method is for example described in US 2008/0190136 or in U.S. Pat. No. 6,578,379.

Such methods give the possibility of obtaining ethane recovery of more than 95% and in the latter case, even more than 99%.

Such a method however does not give entire satisfaction when the feed natural-gas is very rich in heavy hydrocarbons, and notably in ethane, propane and butane, and when the inlet temperature of the feed natural-gas is relatively high.

In these cases, the amount of cooling to be provided is large, which requires the addition of an additional cooling cycle if maintaining good selectivity is desired. Such a cycle consumes energy. Further, in certain facilities, notably floating facilities, it is not possible to apply such cooling cycles.

An object of the invention is therefore to obtain a method for recovering $C_2^+$ hydrocarbons which is extremely efficient and highly selective, even when the content of these $C_2^+$ hydrocarbons in the feed natural-gas increases significantly.

SUMMARY OF THE INVENTION

For this purpose, the subject-matter of the invention is a method of the aforementioned type, comprising the following steps:

- forming at least one second recirculation stream obtained from a methane-rich head stream downstream from the splitter column;
- forming a dynamic expansion stream from the second recirculation stream and introducing the dynamic expansion stream into an expansion turbine for producing frigories.

The method according to the invention may comprise one or several of the following features, taken individually or according to all technically possible combination(s):

- the formation of the turbine input flow includes the division of the light fraction into the turbine input flow and into a secondary flow, the method comprising the cooling of the secondary flow in the second heat exchanger and introducing the cooled secondary flow into an upper portion of the splitter column;

the second recirculation stream is introduced into a stream located downstream from the first heat exchanger and upstream from the first expansion turbine in order to form the dynamic expansion stream;

the second recirculation stream is mixed with the turbine input flow from the separator flask in order to form the dynamic expansion stream, the dynamic expansion turbine receiving the dynamic expansion stream formed by the first expansion turbine;

the second recirculation stream is mixed with the cooled natural-gas stream before its introduction into the separator flask, the dynamic expansion stream being formed by the turbine input flow from the separator flask;

the second recirculation stream is sampled in the first recirculation stream;

the method comprises the following steps:

sampling a stream in the methane-rich head stream before its passing into the first compressor and into the second compressor;

compressing the sampling stream in a third compressor, and forming the second recirculation stream from the compressed sampling stream from the third compressor, and after cooling.

the method comprises the passing of the sampling stream into a third heat exchanger and into a fourth heat exchanger before its introduction into the third compressor, and then the passing of the compressed sampling stream into the fourth heat exchanger, and then into the third heat exchanger in order to feed the head of the splitter column, the second recirculation stream being sampled in the cooled compressed sampling stream, between the fourth heat exchanger and the third heat exchanger;

the sampling stream is introduced into a fourth compressor, the method comprising the following steps:

sampling a secondary diversion stream in the cooled compressed sampling stream from the third compressor and from the fourth compressor;

dynamically expanding the secondary diversion stream in a second expansion turbine coupled with the fourth compressor;

introducing the expanded secondary diversion stream into the sampling stream after its passing into the third compressor and into the fourth compressor;

the second recirculation stream is sampled in the compressed methane-rich head stream, the method comprising the following steps:

introducing the second recirculation stream into a third heat exchanger;

separating the feed natural-gas stream into a first feed flow and into a second feed flow;

establishing a heat exchange relationship of the second feed flow with the second recirculation stream in the third heat exchanger;

mixing the second feed flow after cooling in the third heat exchanger with the first feed flow, downstream from the first exchanger and upstream from the separator flask;

the method comprises the following steps:

sampling a secondary cooling stream in the compressed methane-rich head stream, downstream from the first compressor and upstream from the second compressor;

dynamically expanding the secondary cooling stream in a second expansion turbine and passing of the expanded secondary cooling stream into the third heat exchanger for establishing a heat exchange relationship thereof with the second feed flow and with the second recirculation stream;

reintroducing the expanded secondary cooling stream into the methane-rich stream before its passing into the first compressor and into the second compressor;

sampling a recompression fraction in the cooled methane-rich stream, downstream from the introduction of the expanded secondary cooling stream and upstream from the first compressor and from the second compressor;

compressing the recompression fraction in at least one compressor coupled with the second expansion turbine and reintroducing the compressed recompression fraction into the compressed methane-rich stream from the first compressor and from the second compressor;

the second recirculation stream is derived from the first recirculation stream in order to form the dynamic expansion stream, the dynamic expansion stream being introduced into a second expansion turbine distinct from the first expansion turbine, the dynamic expansion stream from the second expansion turbine being reintroduced into the methane-rich stream before its passing into the first heat exchanger;

the method comprises the following steps:

sampling a recompression fraction in the heated-up methane-rich head stream from the first exchanger and from the second heat exchanger;

compressing the recompression fraction in a third compressor coupled with the second expansion turbine;

introducing the compressed recompression fraction into the compressed methane-rich stream from the first compressor;

the method comprises the diversion of a third recirculation stream advantageously at room temperature, from the at least partly compressed methane-rich stream, advantageously between two stages of the second compressor, the third recirculation stream being successively cooled in the first heat exchanger and in the second heat exchanger before being mixed with the first recirculation stream in order to be introduced into the splitter column;

the $C_2^+$ hydrocarbon-rich bottom stream is pumped and is heated up by heat exchange with a counter-current of at least one portion of the feed natural-gas stream, advantageously up to a temperature less than or equal to the temperature of the feed natural-gas stream before its passing into the first heat exchanger;

the pressure of the $C_2^+$ hydrocarbon-rich stream after pumping is selected for maintaining the $C_2^+$ hydrocarbon-rich stream after its heating up in the first heat exchanger, in liquid form;

the molar flow rate of the second recirculation stream is greater than 10% of the molar flow rate of the feed natural-gas stream;

the temperature of the second recirculation stream is substantially equal to the temperature of the cooled natural gas stream introduced into the separator flask;

the pressure of the third recirculation stream is less than the pressure of the feed natural-gas stream and is greater than the pressure of the splitter column;

the molar flow rate of the third recirculation stream is greater than 10% of the molar flow rate of the feed natural-gas stream;

the molar flow rate of the sampling stream is greater than 4%, advantageously greater than 10% of the molar flow rate of the feed natural-gas stream;

the temperature of the sampling stream after passing into the third heat exchanger is less than that of the cooled feed natural-gas stream feeding the separator flask;

the molar flow rate of the secondary diversion stream is greater than 10% of the molar flow rate of the feed natural-gas stream;

the molar flow rate of the secondary cooling stream is greater than 10% of the molar flow rate of the feed natural-gas stream;

the pressure of the expanded secondary cooling stream is greater than 15 bars;

the ratio between the ethane flow rate contained in the $C_2^+$ hydrocarbon-rich fraction and the ethane flow rate contained in the feed natural-gas is greater than 0.98;

the ratio between the $C_3^+$ hydrocarbon flow rate contained in the $C_2^+$ hydrocarbon-rich fraction and the $C_3^+$ hydrocarbon flow rate contained in the feed natural-gas stream is greater than 0.998.

The subject-matter of the invention is also a facility for producing a methane-rich stream and a $C_2^+$ hydrocarbon-rich fraction from a dehydrated feed natural-gas stream, consisting of hydrocarbons, nitrogen and $CO_2$, and advantageously having a molar $C_2^+$ hydrocarbon content of more than 10%, the facility being of the type comprising:

a first heat exchanger for cooling the feed natural-gas stream advantageously circulating at a pressure of more than 40 bars, a separator flask, means for introducing the cooled feed natural-gas stream into the separator flask, the cooled feed natural-gas stream being separated in the separator flask in order to recover an essentially gaseous light fraction and an essentially liquid heavy fraction;

means for forming a turbine input flow from the light fraction;

a first dynamic expansion turbine for the turbine input flow;

a splitter column;

means for introducing the expanded flow into the first dynamic expansion turbine in an intermediate portion of the splitter column;

a second heat exchanger;

means for expanding and introducing the heavy fraction into the splitter, laid out so that the recovered heavy fraction in the separator flask is introduced into the splitter column without passing through the first heat exchanger;

means for recovering, at the bottom of the splitter column, a $C_2^+$ hydrocarbon-rich bottom stream intended to form the $C_2^+$ hydrocarbon-rich fraction;

means for sampling at the head of the splitter column, a methane-rich head stream;

means for introducing the methane-rich head stream into the second heat exchanger and into the first heat exchanger for heating it up;

means for compressing the methane-rich head stream comprising at least one first compressor coupled with the first turbine and a second compressor for forming the methane-rich stream from the compressed methane-rich head stream;

means for sampling in the methane-rich head stream a first recirculation stream;

means for passing the first recirculation stream into the first heat exchanger and then into the second heat exchanger in order to cool it down;

means for introducing at least one portion of the first cooled recirculation stream into the upper portion of the splitter column;

the facility comprising:

means for forming at least one second recirculation stream obtained from the methane-rich head stream downstream from the splitter column;

means for forming a dynamic expansion stream from the second recirculation stream;

means for introducing the dynamic expansion stream into an expansion turbine for producing frigories.

In an embodiment, the means for forming a dynamic expansion stream from the second recirculation stream comprise means for introducing the second recirculation stream into a stream circulating downstream from the first heat exchanger and upstream from the first expansion turbine in order to form the dynamic expansion stream.

In another embodiment, the means for forming the turbine input flow include means for dividing the light fraction into the turbine input flow and into a secondary flow, the facility comprising means for passing the secondary flow into the second heat exchanger for cooling it down and means for introducing the cooled secondary flow into an upper portion of the splitter column.

By «room temperature», is meant in the following the temperature of the gas atmosphere prevailing in the facility in which the method according to the invention is applied; This temperature is generally comprised between −40° C. and 60° C.

BRIEF DESCRIPTION OF THE DRAWINGS

The invention will be better understood upon reading the description which follows, only given as an example, and made with reference to the appended drawings, wherein.

DESCRIPTION OF PREFERRED EMBODIMENTS

Figure 1:
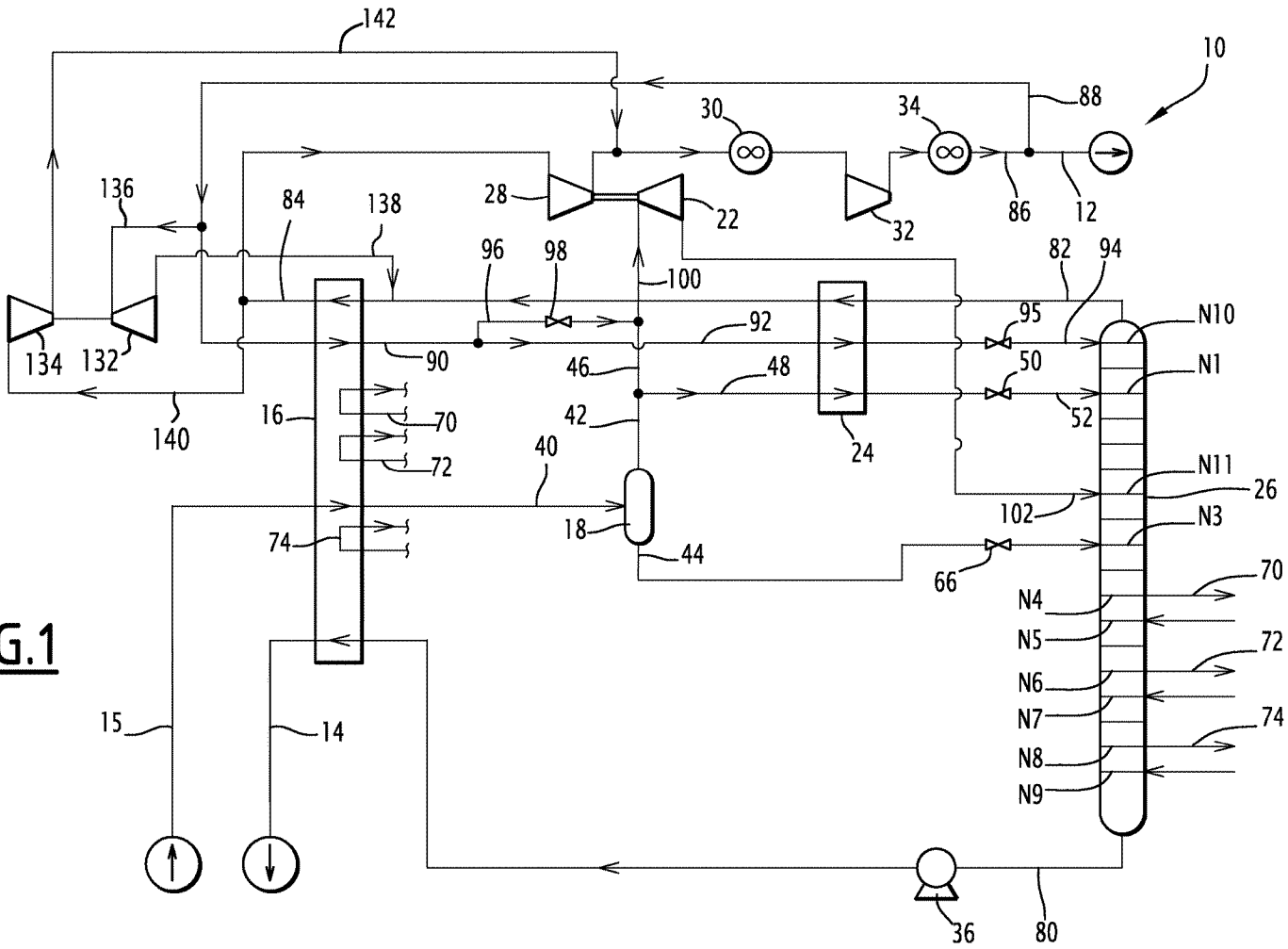
FIG. 1 is a block diagram of a first facility according to the invention, for applying a first method according to the invention.

FIG. 1 illustrates a first facility 10 for producing a methane-rich stream 12 and a $C_2^+$ hydrocarbon-rich fraction 14 according to the invention, from a feed natural-gas 15. This facility 10 is intended for application of a first method according to the invention.

The method and the facility 10 are advantageously applied in the case of the building of a new unit for recovering methane and ethane.

The facility 10 from upstream to downstream comprises a first heat exchanger 16, a separator flask 18, a first expansion turbine 22 and a second heat exchanger 24.

The facility 10 further comprises a splitter column 26 and, downstream from the column 26, a first compressor 28 coupled with the first expansion turbine 22, a first air cooler 30, a second compressor 32 and a second air cooler 34. The facility 10 further comprises a column bottom pump 36.

In the example illustrated in FIG. 1, the facility 10 further includes a second expansion turbine 132 and a third compressor 134.

In all the following, a stream circulating in a conduit and the conduit which conveys it will be designated by the same references. Further, unless indicated otherwise, the mentioned percentages are molar percentages and the pressures are given in absolute bars.

Further, for numerical simulations, the yield of each compressor is 82% polytrophic and the yield of each turbine is 85% adiabatic.

A first production method according to the invention, applied in the facility 10 will now be described.

The field natural gas 15 is, in this example, a dehydrated and decarbonated natural gas comprising by moles, 0.3499% of nitrogen, 80.0305% of methane, 11.3333% of ethane, 3.6000% of propane, 1.6366% of i-butane, 2.0000% of n-butane, 0.2399% of i-pentane, 0.1899% of n-pentane, 0.1899% of n-hexane, 0.1000% of n-heptane, 0.0300% of n-octane and 0.3000% of carbon dioxide.

The feed natural gas 15 therefore more generally comprises by moles, between 10% and 25% of $C_2^+$ hydrocarbons to be recovered and between 74% and 89% of methane. The $C_2^+$ hydrocarbon content is advantageously greater than 15%.

By decarbonated gas, is meant a gas for which the carbon dioxide content is lowered so as to avoid crystallization of carbon dioxide, this content being generally less than 1 molar %.

By dehydrated gas, is meant a gas for which the water content is as low as possible and notably less than 1 ppm.

Further, the hydrogen sulfide content of the feed natural-gas 15 is preferentially less than 10 ppm and the content of sulfur-containing compounds of the mercaptan type is preferentially less than 30 ppm.

The feed natural-gas has a pressure of more than 40 bars and notably substantially equal to 62 bars. It further has a temperature close to room temperature and notably equal to 40° C. The flow rate of the feed natural-gas stream 15 in this example is 15,000 kg.mol/h. The feed natural-gas stream 15 is first of all introduced into the first heat exchanger 16 where it is cooled and partly condensed at a temperature above −50° C. and notably substantially equal to −24.5° C. in order to provide a cooled feed natural-gas stream 40 which is entirely introduced into the separator flask 18.

In the separator flask 18, the cooled feed natural-gas stream 40 is separated into a gaseous light fraction 42 and a liquid heavy fraction 44.

The ratio of the molar flow rate of the light fraction 42 to the molar flow rate of the heavy fraction 44 is generally comprised between 4 and 10.

Next, the light fraction 42 is separated into a flow 46 for feeding the first expansion turbine and into a secondary flow 48 which is successively introduced into the heat exchanger 24 and in a first static expansion valve 50 for forming a cooled and at least partly liquefied expanded secondary flow 52.

The cooled expanded secondary flow 52 is introduced at an upper level N1 of the splitter column 26 corresponding in this example to the fifth stage from the top of the splitter column 26.

The flow rate of the secondary flow 48 represents less than 40% of the flow rate of the light fraction 42.

The pressure of the secondary flow 52, after its expansion in the valve 50 is less than 20 bars and notably equal to 16 bars. This pressure substantially corresponds to the pressure of the column 26 which is more generally greater than 15 bars, advantageously comprised between 15 bars and 25 bars.

The cooled expanded secondary flow 52 comprises a molar ethane content of more than 5% and notably substantially equal to 9.5 molar % of ethane.

The heavy fraction 44 is directed towards an expansion valve 66 which opens depending on the liquid level in the separator flask 18.

The totality of the heavy fraction 44 is introduced into the column 26, without entering a heat exchange relationship with the feed gas 15, in particular, upstream from the separator flask 18. The heavy fraction 44 does not pass through the first heat exchanger 16. Advantageously, the heavy fraction 44 is not separated either between the flask 18 and the column 26.

The foot fraction 44, after having been expanded at the pressure of the column 26, is then introduced to a level N3 of the column located under the level N1, advantageously located at the twelfth stage of the column 26 starting from the head.

An upper reboiling stream 70 is sampled at a bottom level N4 of the column 26 located under the level N3 and corresponding to the thirteenth stage starting from the head of the column 26. This reboiling stream is available at a temperature above −55° C., in this example −53° C., and is passed into the first heat exchanger 16 so as to be partly vaporized and to exchange heat power of about 2,710 kW with the upper streams circulating in the exchanger 16.

The partly vaporized liquid reboiling stream is heated up to a temperature of more than −40° C. and notably equal to −35.1° C. and sent to the level N5 located just below the level N4, and corresponding to the fourteenth stage of the column 26 from the head.

A second intermediate reboiling stream 72 is collected at a level N6 located under the level N5 and corresponding to the seventeenth stage starting from the head of the column 26. This second reboiling stream 72 is sampled at a temperature of more than −25° C., notably at −21.4° C. in order to be sent into the first exchanger 16 and to exchange a heat power of about 1,500 kW with the other streams circulating in this exchanger 16.

The partly vaporized liquid reboiling stream from the exchanger 16 is then reintroduced at a temperature of more than −20° C. and notably equal to −13.7° C. at a level N7 located just below the level N6 and notably at the eighteenth stage from the head of the column 26.

Further, a third lower reboiling stream 74 is sampled in the vicinity of the bottom of the column 26 at a temperature of more than −10° C. and notably substantially equal to −3.3° C. at a level N8 advantageously located at the twenty-first stage starting from the head of the column 26.

The lower reboiling stream 74 is brought as far as the first heat exchanger 16 where it is heated up to a temperature of more than 0° C. and notably equal to 3.2° C. before being sent to a level N9 corresponding to the twenty-second stage starting from the top of the column 26. This reboiling stream exchanges heat power of about 2,840 kW with the other streams circulating in the exchanger 16.

A $C_2^+$ hydrocarbon-rich stream 80 is sampled in the bottom of the column 26 at a temperature of more than −5° C. and notably equal to 3.2° C. This stream comprises less than 1% of methane and more than 98% of $C_2^+$ hydrocarbons. It contains more than 99% of $C_2^+$ hydrocarbons from the feed natural-gas stream 15.

In the illustrated example, the stream 80 contains by moles, 0.52% of methane, 57.80% of ethane, 18.5% of propane, 8.4% of i-butane, 10.30% of n-butane, 1.23% of i-pentane, 0.98% of n-pentane, 0.98% of n-hexane, 0.51% of n-heptane, 0.15% of n-octane, 0.54% of carbon dioxide , 0% of nitrogen.

This liquid stream 80 is pumped into the column bottom pump 36 and is then introduced into the first heat exchanger 16 so as to be heated up therein up to a temperature of more than 25° C. while remaining liquid. It thus produces the $C_2^+$ hydrocarbon-rich fraction 14 at a pressure of more than 25 bars and notably equal to 31.2 bars, advantageously at 38° C.

A methane-rich head stream 82 is produced at the head of the column 26. This head stream 82 comprises a molar content of more than 99.1% of methane and a molar content of less than 0.15% of ethane. It contains more than 99.8% of the methane contained in the feed natural-gas 15.

The methane-rich head stream 82 is successively heated up in the second heat exchanger 24, and then in the first heat exchanger 16 in order to provide a methane-rich head stream 84 heated up to a temperature below 40° C. and notably equal to 30.8° C.

In this example, a first portion of the stream 84 is compressed once in the first compressor 28 and is then cooled in the first air cooler 30.

The obtained stream is then compressed a second time in the second compressor 32 and is cooled in the second air cooler 34 in order to provide a compressed methane-rich head stream 86.

The temperature of the compressed stream 86 is substantially equal to 40° C. and its pressure is greater than 60 bars and is notably substantially equal to 63.1 bars.

The compressed stream 86 is then separated into a methane-rich stream 12 produced by the facility 10, and into a first recirculation stream 88.

The ratio of the molar flow rate of the methane-rich stream 12 to the molar flow rate of the first recirculation stream is greater than 1 and is notably comprised between 1 and 20.

The stream 12 includes a methane content of more than 99.0%. In this example, it consists of 99.18 molar % of methane, 0.14 molar % of ethane, 0.43 molar % of nitrogen and 0.24 molar % of carbon dioxide. This stream 12 is then sent into a gas pipeline.

The first methane-rich recirculation stream 88 is then directed towards the first heat exchanger 16 in order to provide the first cooled recirculation stream 90 at a temperature of less than −30° C. and notably equal to −45° C.

A first portion 92 of the first cooled recirculation stream 90 is then introduced into the second exchanger 24 so as to be liquefied therein before passing through the flow rate control valve 95. The thereby obtained stream forms a first cooled and at least partly liquefied portion 94 introduced to a level N10 of the column 26 located above the level N1, notably at the first stage of the column from the head. The temperature of the first cooled portion 94 is more than −120° C. and notably equal to −113.8° C. Its pressure, after passing into the valve 95 is substantially equal to the pressure of the column 26.

According to the invention, a second portion 96 of the first cooled recirculation stream 90 is sampled for forming a second methane-rich recirculation stream.

This second portion 96 is expanded in an expansion valve 98 before being mixed with the turbine input flow 46 in order to form a flow 100 for feeding the first expansion turbine 22 intended to be dynamically expanded in this turbine 22 in order to produce frigories.

The feed flow 100 is expanded in the turbine 22 in order to form an expanded flow 102 which is introduced into the column 26 at a level N11 located between the level N1 and the level N3, notably at the tenth stage starting from the head of the column at a pressure substantially equal to 16 bars.

The dynamic expansion of the flow 100 in the turbine 22 allows 3,732 kW of energy to be recovered which for a fraction of more than 50% and notably equal to 99.5% stem from the turbine input flow 46 and for a fraction of less than 50% and notably equal to 0.5% from the second recirculation stream.

The flow 100 therefore forms a dynamic expansion stream which, by its expansion in the turbine 22, produces frigories.

In the example illustrated in FIG. 1, the method further comprises the sampling of a fourth recirculation stream 136 in the first recirculation stream 88. This fourth recirculation stream 136 is sampled in the first recirculation stream 88 downstream from the second compressor 32 and upstream from the passage of the first recirculation stream 88 in the first exchanger 16 and in the second exchanger 24.

The molar flow rate of the fourth recirculation stream 136 represents less than 80% of the molar flow rate of the first recirculation stream 88 sampled at the outlet of the second compressor 32.

The fourth recirculation stream 136 is then brought as far as the second dynamic expansion turbine 132 so as to be expanded to a pressure below the pressure of the splitter column 26 and notably equal to 15.4 bars and for producing frigories. The temperature of the fourth cooled recirculation stream 138 from the turbine 132 is thus less than −30° C. and notably substantially equal to −43.1° C.

The fourth cooled recirculation stream 138 is then reintroduced into the methane-rich head stream 82 between the outlet of the second exchanger 24 and the inlet of the first exchanger 16. Thus, the frigories generated by the dynamic expansion in the turbine 132 are transmitted by heat exchange into the first exchanger 16 to the feed natural-gas stream 15. This dynamic expansion allows recovery of 2,677 kW of energy.

Further, a recompression fraction 140 is sampled in the heated-up methane-rich head stream 84 between the outlet of the first exchanger 16 and the inlet of the first compressor 28. This recompression fraction 140 is introduced into the first compressor 134 coupled with the second turbine 132 so as to be compressed up to a pressure of less than 30 bars and notably equal to 22.6 bars and to a temperature of about 68.2° C.

The compressed recompression fraction 142 is reintroduced into the cooled methane-rich stream between the outlet of the first compressor 38 and the inlet of the first air cooler 30.

The molar flow rate of the recompression fraction 140 is greater than 20% of the molar flow rate of the feed gas stream 15.

As compared with a facility in which the totality of the first recirculation stream 90 is reinjected into the column 26, the method according to the invention gives the possibility of obtaining ethane recovery identical, greater than or equal to 99%, while notably reducing the power to be provided by the second compressor 32 from 19,993 kW to 18,063 kW.

The improvement in the yield of the facility is illustrated by Table 1 hereafter.

TABLE 1

| Ethane recovery % mol | Flow rate of the stream 136 recycled to the turbine 132 kg · mol/h | Power of the compressor 32 kW | Pressure of the column 26 bars |
|---|---|---|---|
| 99.00 | 0 | 19993 | 14.20 |
| 99.00 | 1000 | 19268 | 14.65 |
| 99.00 | 2000 | 18697 | 15.00 |
| 99.00 | 3000 | 18283 | 15.40 |
| 99.00 | 4000 | 18063 | 15.90 |

Temperature, pressure and molar flow rate examples of the various streams are given in Table 2 below.

TABLE 2

| Stream | Temperature (° C.) | Pressure (bars) | Flow rate (kg · mol/h) |
|---|---|---|---|
| 12 | 40.0 | 63.1 | 12088 |
| 14 | 38.0 | 31.2 | 2912 |
| 15 | 40.0 | 62.0 | 15000 |
| 40 | −24.5 | 61.0 | 15000 |
| 42 | −24.5 | 61.0 | 12597 |
| 44 | −24.5 | 61.0 | 2403 |
| 46 | −24.5 | 61.0 | 8701 |
| 52 | −110.2 | 16.1 | 3896 |
| 80 | 3.2 | 16.1 | 2912 |
| 82 | −112.4 | 15.9 | 13278 |
| 84 | 30.8 | 14.9 | 17278 |
| 86 | 40.0 | 63.1 | 17278 |
| 88 | 40.0 | 63.1 | 5190 |
| 90 | −45.0 | 62.6 | 1190 |
| 94 | −113.8 | 16.1 | 1145 |
| 96 | −45.0 | 62.6 | 45 |
| 100 | −24.6 | 61.0 | 8746 |
| 102 | −76.2 | 16.1 | 8746 |
| 138 | −43.1 | 15.4 | 4000 |
| 142 | 68.2 | 22.6 | 7218 |

Figure 2:
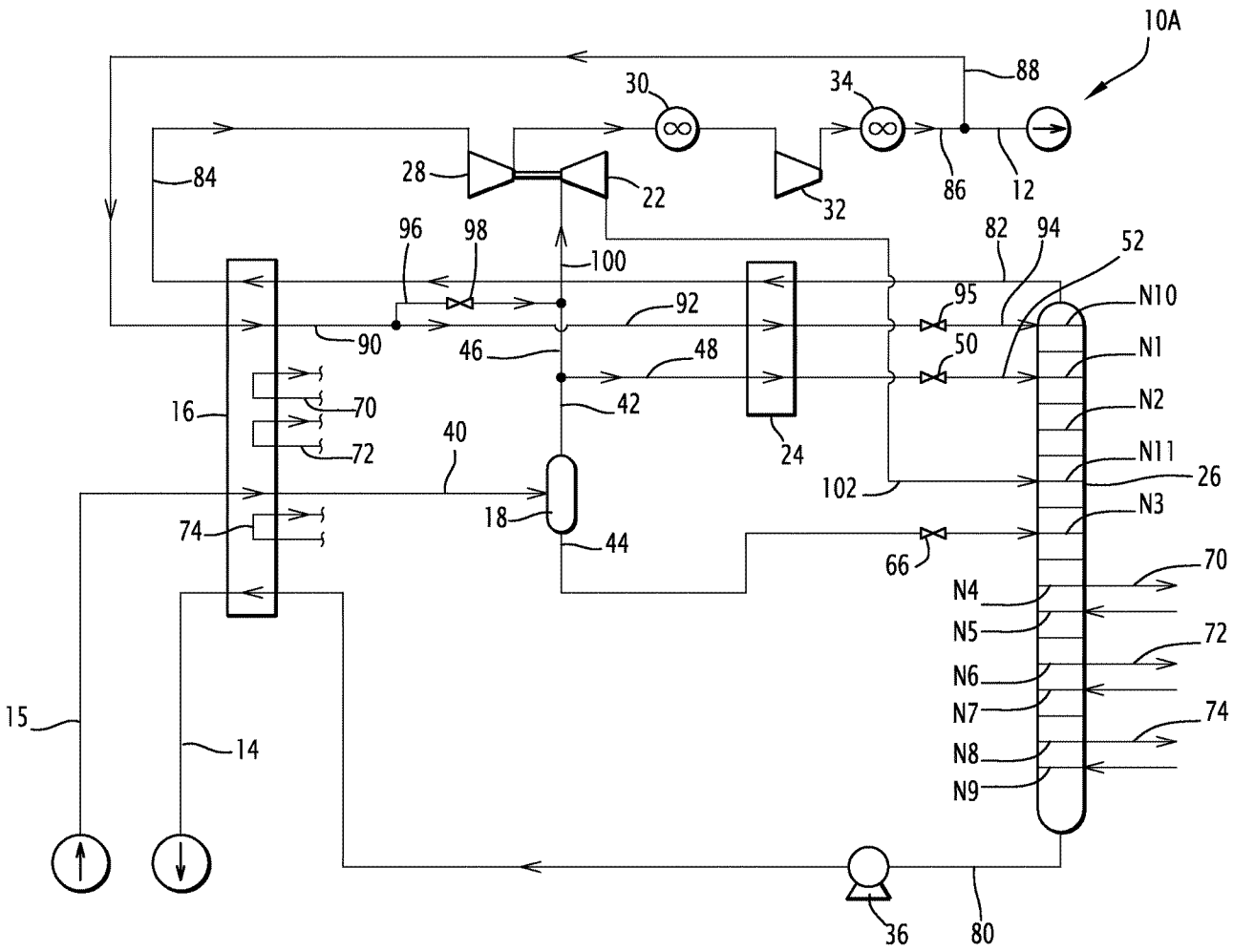
FIG. 2 is a view similar to FIG. 1 of an alternative of the facility of FIG. 1.

In an alternative 10A of the first facility 10 illustrated in FIG. 2, the facility is without the second dynamic expansion turbine 132 and the third compressor 134 coupled with the second dynamic expansion turbine 132.

The totality of the heated-up head stream 84 from the first heat exchanger 16 is then introduced into the first compressor 28. Also, the totality of the first recirculation stream 88 is introduced into the first heat exchanger 16 in order to form the stream 90.

The facility and the method applied in this facility 10A are moreover similar to the first facility 10 and to the first method according to the invention.

Figure 3:
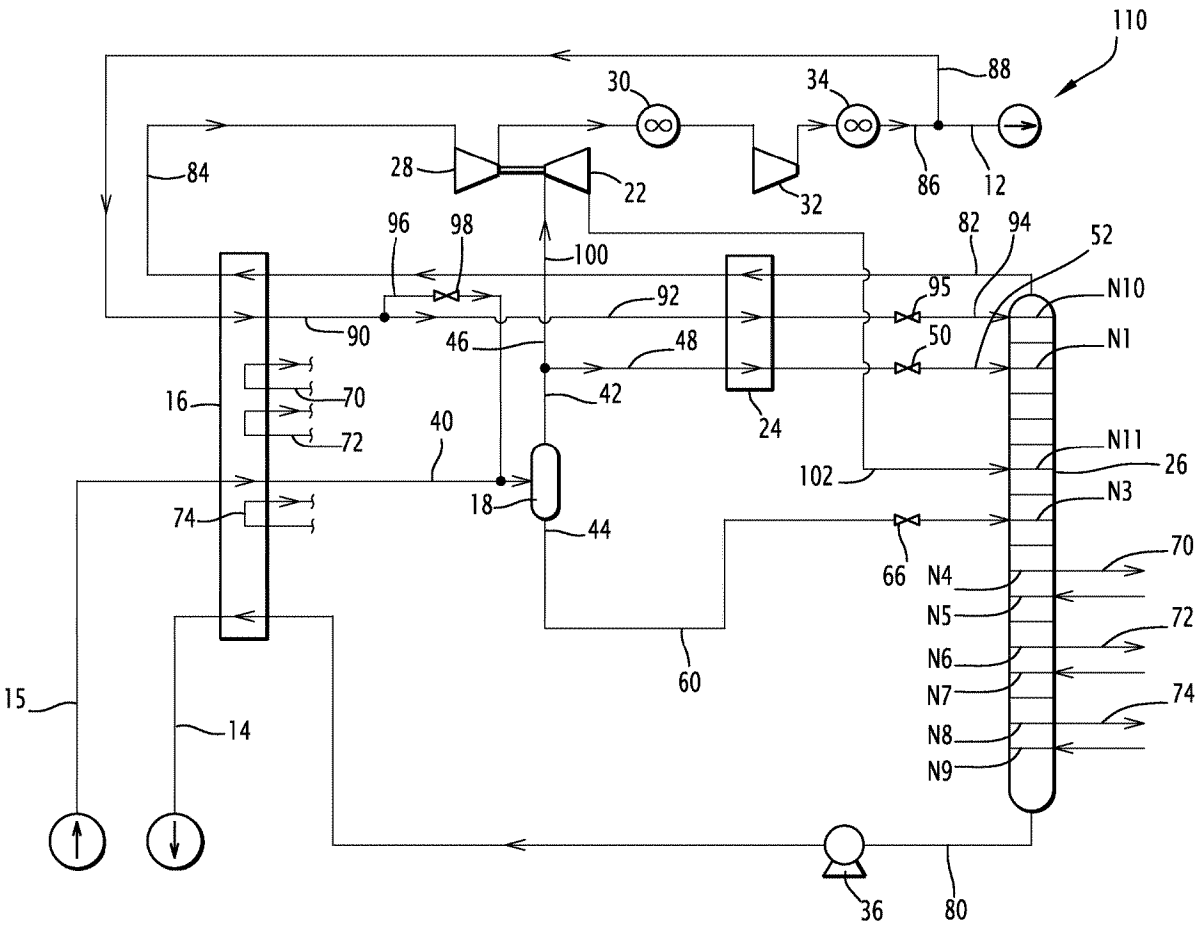
FIG. 3 is a view similar to FIG. 1 of a second facility according to the invention, for applying a second method according to the invention.

A second facility 110 according to the invention is illustrated in FIG. 3. This second facility 110 is intended for applying a second method according to the invention.

Unlike the first method according to the invention and its alternative illustrated in FIG. 2, the second portion 96 of the first cooled recirculation stream 90 forming the second recirculation stream is reintroduced, after expansion in the control valve 98, upstream from the column 26, into the cooled natural gas stream 40, between the first exchanger 16 and the separator flask 18.

In this example, this second stream 96 contributes to the formation of the light fraction 42, as well as to the formation of the flow for feeding the first expansion turbine 22.

Moreover, in this example, the flow 100 is exclusively formed by the feed flow 46.

This arrangement, which may be applied to the whole of the described methods gives the possibility of further slightly improving the yield of the facility.

Figure 4:
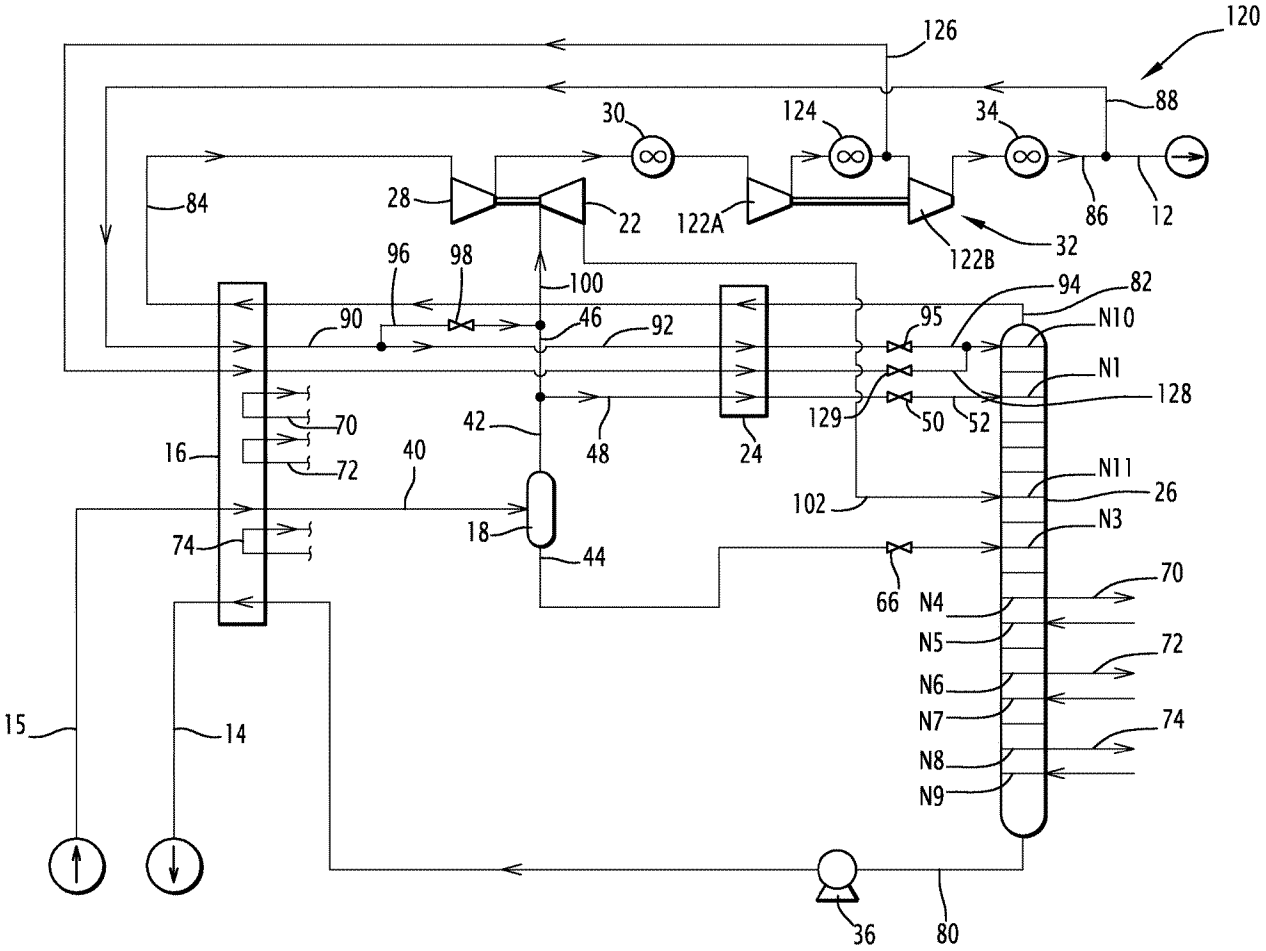
FIG. 4 is a view similar to FIG. 1 of a third facility according to the invention, for applying a third method according to the invention.

A third facility 120 according to the invention is illustrated in FIG. 4. This third facility 120 is intended for applying a third method according to the invention.

Unlike the first facility 10 and its alternative 10A, the second compressor 32 of the third facility 120 comprises two compression stages 122A, 122B and an intermediate air coolant 124 interposed between both stages.

Unlike the first method according to the invention and its alternative illustrated in FIG. 2, the third method according to the invention comprises the sampling of a third recirculation stream 126 in the heated-up methane-rich head stream 84. This third recirculation stream 126 is sampled between both stages 122A, 122B at the outlet of the intermediate coolant 124. Thus, the stream 126 has a pressure of more than 30 bars and a temperature substantially equal to room temperature.

The ratio of the flow rate of the third recirculation stream to the total flow rate of the heated-up methane-rich head stream 84 from the first heat exchanger 16 is less than 0.15 and is notably comprised between 0.08 and 0.15.

The third recirculation stream 126 is then successively introduced into the first exchanger 16, and then into the second exchanger 24 so as to be cooled to a temperature of more than −110.5° C.

This stream 128, obtained after expansion in a control valve 129, is then reintroduced as a mixture with the first portion 94 of the first cooled recirculation stream 90 between the control valve 95 and the column 26.

A reduction in the consumed power is observed, about 3% of which is due to liquefaction at a medium pressure of the third recirculation stream 126.

Figure 5:
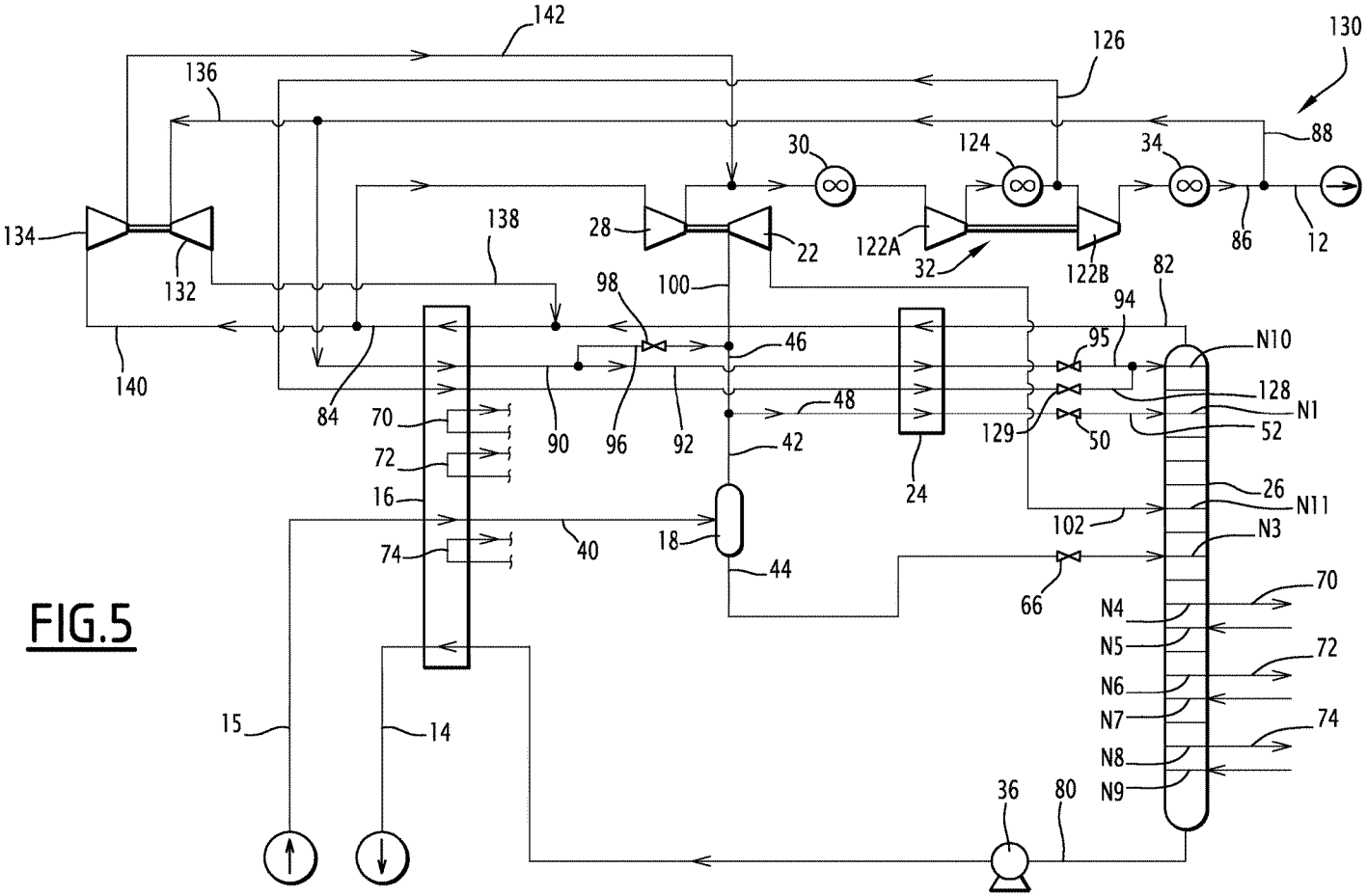
FIG. 5 is a view similar to FIG. 1 of a fourth facility according to the invention, for applying a fourth method according to the invention.

A fourth facility 130 according to the invention is illustrated in FIG. 5. This fourth facility 130 is intended for the application of a fourth method according to the invention.

The fourth method according to the invention differs from the alternative of the first method according to the invention in that it comprises the sampling of a third recirculation stream 126 in the heated-up methane-rich head stream 84, like in the third method according to the invention.

As described earlier for the method of FIG. 4, the third recirculation stream 126 is then successively introduced into the first exchanger 16, and then into the second exchanger 24 so as to be cooled to a temperature of more than −109.7° C.

This stream 128, obtained after expansion in a control valve 129, is then reintroduced as a mixture with the first portion 94 of the first cooled recirculation stream 90 between the control valve 95 and the column 26.

In this alternative of the fourth method, almost the whole of the first cooled recirculation stream 90 from the first exchanger 16 is introduced into the second exchanger 24. The flow rate of the second portion 96 of this stream illustrated in FIG. 5 is quasi-zero.

In this alternative, the second recirculation stream is then formed by the fourth recirculation stream 136 which is brought as far as the dynamic expansion turbine 132 for producing frigories.

Further, the application of this alternative of the method according to the invention does not require provision of a conduit with which a portion of the first cooled recirculation stream 90 may be diverted towards the first turbine 22, so that the installation 130 may be without one.

Figure 6:
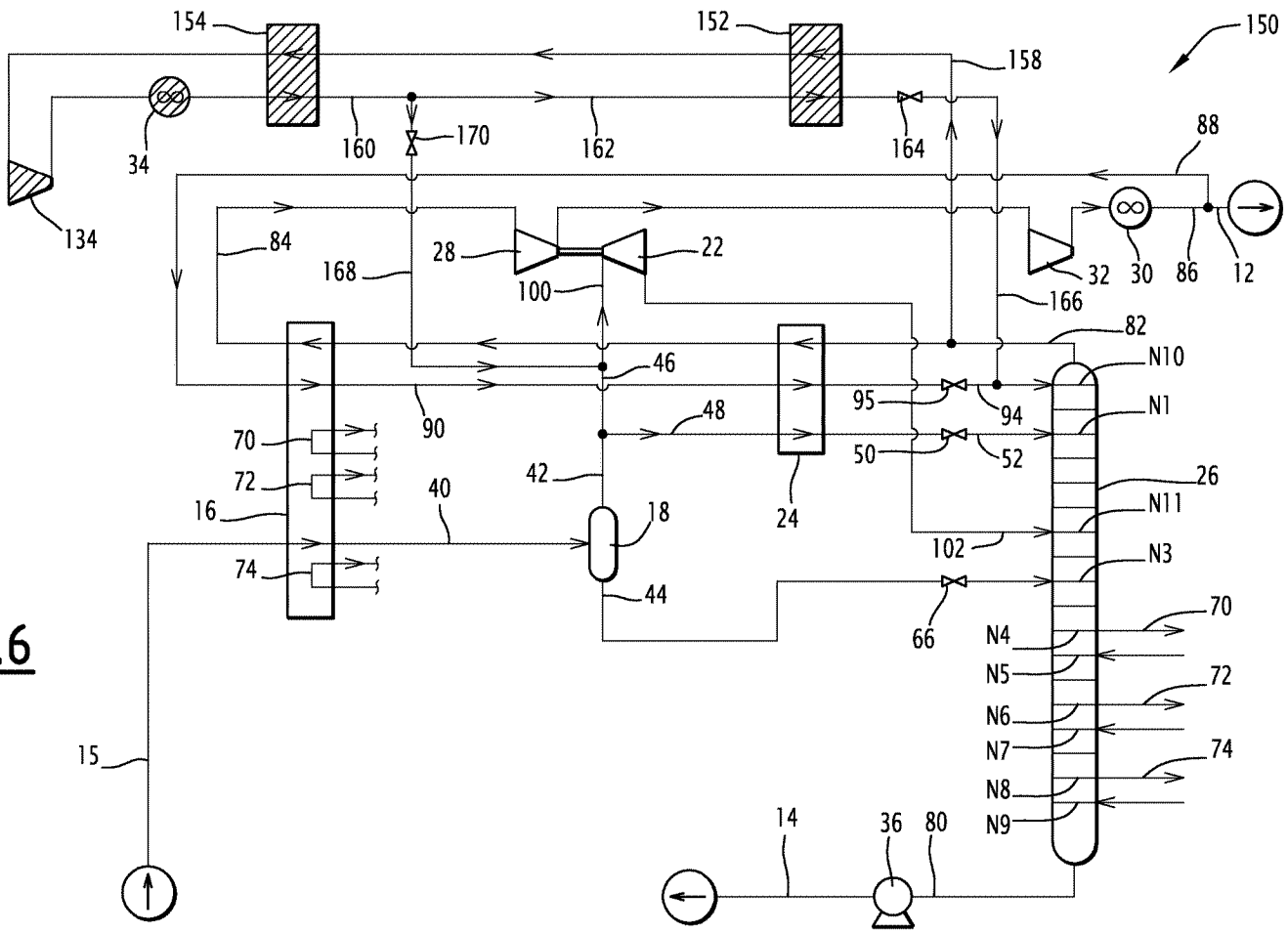
FIG. 6 is a view similar to FIG. 1 of a fifth facility according to the invention, for applying a fifth method according to the invention.

A fifth facility 150 according to the invention is illustrated in FIG. 6. This fifth facility 150 is intended for application of a fifth method according to the invention.

This facility 150 is intended for improving an existing production unit of the state of the art, as for example described in the American patent U.S. Pat. No. 6,578,379, by keeping constant the power consumed by the second compressor 32, notably when the $C_2^+$ hydrocarbon content in the feed gas 15 substantially increases.

The initial feed natural-gas 15 in this example and in the following examples is a dehydrated and decarbonated natural gas mainly consisting of methane and of $C_2^+$ hydrocarbons, comprising by moles 0.3499% of nitrogen, 89.5642% of methane, 5.2579% of ethane, 2.3790% of propane, 0.5398% of i-butane, 0.6597% of n-butane, 0.2399% de i-pentane, 0.1899% of n-pentane, 0.1899% of n-hexane, 0.1000% of n-heptane, 0.0300% of n-octane, 0.4998% of $CO_2$.

In the example shown, the $C_2^+$ hydrocarbon fraction always has the same composition which is the one indicated in table 3:

TABLE 3

| | |
|---|---|
| Ethane | 54.8494 Mol % |
| Propane | 24.8173 Mol % |
| i-Butane | 5.6311 Mol % |
| n-Butane | 6.8815 Mol % |
| i-Pentane | 2.5026 Mol % |
| n-Pentane | 1.9810 Mol % |
| C6+ | 3.3371 Mol % |
| Total | 100 Mol % |

The fifth facility 150 according to the invention differs from the alternative 10A of the first facility illustrated in FIG. 2 in that it comprises a third heat exchanger 152, a fourth heat exchanger 154 and a third compressor 134.

The facility 150 is further without any air cooler at the outlet of the first compressor 28. The first air cooler 30 is located at the outlet of the second compressor 32.

However it comprises a second air cooler 34 mounted at the outlet of the third compressor 134.

The fifth method according to the invention differs from the alternative of the first method according to the invention in that a sampling stream 158 is sampled in the methane-rich head stream 82 between the outlet of the splitter column 26 and the second heat exchanger 24.

The sampling stream flow rate 158 is less than 15% of the flow rate of the methane-rich head stream 82 from the column 26.

The sampling stream 158 is then successively introduced into the third heat exchanger 152, so as to be heated up to a first temperature below room temperature, and then in the fourth heat exchanger 154 so as to be heated up to substantially room temperature.

The first temperature is further less than the temperature of the cooled feed natural-gas stream 40 feeding the separator flask 18.

The thereby cooled stream 158 is passed into the third compressor 134 and into the cooler 34, in order to cool it down to room temperature before being introduced into the fourth heat exchanger 154 and forming a cooled compressed sampling stream 160.

This cooled compressed sampling stream 160 has a pressure greater than or equal to that of the feed gas stream 15. This pressure is less than 63 bars. The stream 160 has a temperature of less than 40° C. This temperature is substantially equal to the temperature of the cooled feed natural gas stream 40 feeding the separator flask 18.

The cooled compressed sampling stream 160 is separated into a first portion 162 which is successively passed into the third heat exchanger 152 so as to be cooled therein substantially down to the first temperature, and then in a pressure control valve 164 for forming a first cooled expanded portion 166.

The molar flow rate of the first portion 162 represents at least 4% of the molar flow rate of the feed natural-gas stream 15.

The pressure of the first cooled expanded portion 166 is substantially equal to the pressure of the column 26.

The ratio of the molar flow rate of the first portion 162 to the molar flow rate of the cooled compressed sampling stream 160 is greater than 0.25. The molar flow rate of the first portion 162 is greater than 4% of the molar flow rate of the feed natural-gas stream 15.

A second portion 168 of the cooled compressed sampling stream is introduced after passing into a static expansion valve 170, as a mixture with the flow 46 feeding the first turbine 22 in order to form the flow 100 for feeding this turbine 22.

Thus, the second portion 168 forms the second recirculation stream according to the invention which is introduced into the turbine 22 in order to produce frigories therein. As an alternative (not shown), the second portion 168 is introduced into the cooled feed natural gas stream 40 upstream from the separator flask 18, as illustrated in FIG. 3.

It is thus possible to keep the second compressor 32, without modifying its size, for a production facility receiving a richer gas in $C_2^+$ hydrocarbons, without degrading the recovery of ethane.

Figure 7:
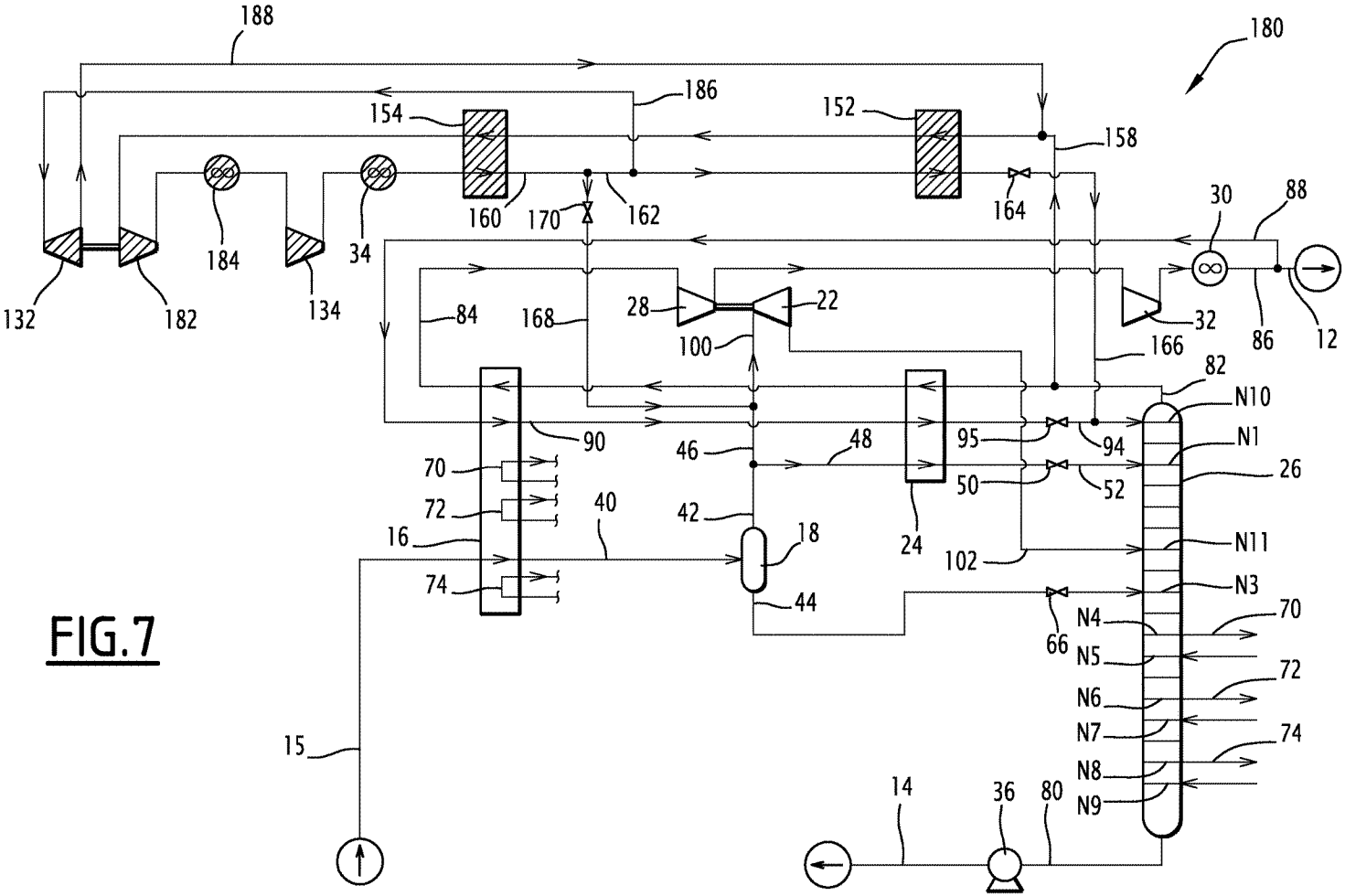
FIG. 7 is a view similar to FIG. 1 of a sixth facility according to the invention, for applying a sixth method according to the invention.

A sixth facility according to the invention 180 is illustrated in FIG. 7. This sixth facility 180 is intended for applying a sixth method according to the invention.

This sixth facility 180 differs from the fifth facility 150 in that it further comprises a fourth compressor 182, a second expansion turbine 132 coupled with the fourth compressor 182, and a third air cooler 184.

Unlike the fifth method, the sampling stream 158 is introduced, after its passing into the fourth exchanger 154, successively into the fourth compressor 182, in the third air cooler 184 before being introduced into the third compressor 134.

Further, a secondary diversion stream 186 is sampled in the first portion 162 of the cooled compressed sampling stream 160 before its passing into the third exchanger 152.

The secondary diversion stream 186 is then conveyed as far as the second expansion turbine 132 so as to be expanded down to a pressure of less than 25 bars, which lowers its temperature to less than −90° C.

The thereby formed expanded secondary diversion stream 188 is introduced as a mixture into the sampling stream 158 before its passing into the third exchanger 152.

The flow rate of the secondary diversion stream is less than 75% of the flow rate of the stream 160 taken at the outlet of the fourth exchanger 154.

It is thus possible to increase the $C_2^+$ content in the feed stream without modifying the power consumed by the compressor 32, or modifying the power developed by the first expansion turbine 22, while minimizing the power consumed by the compressor 134.

Figure 8:
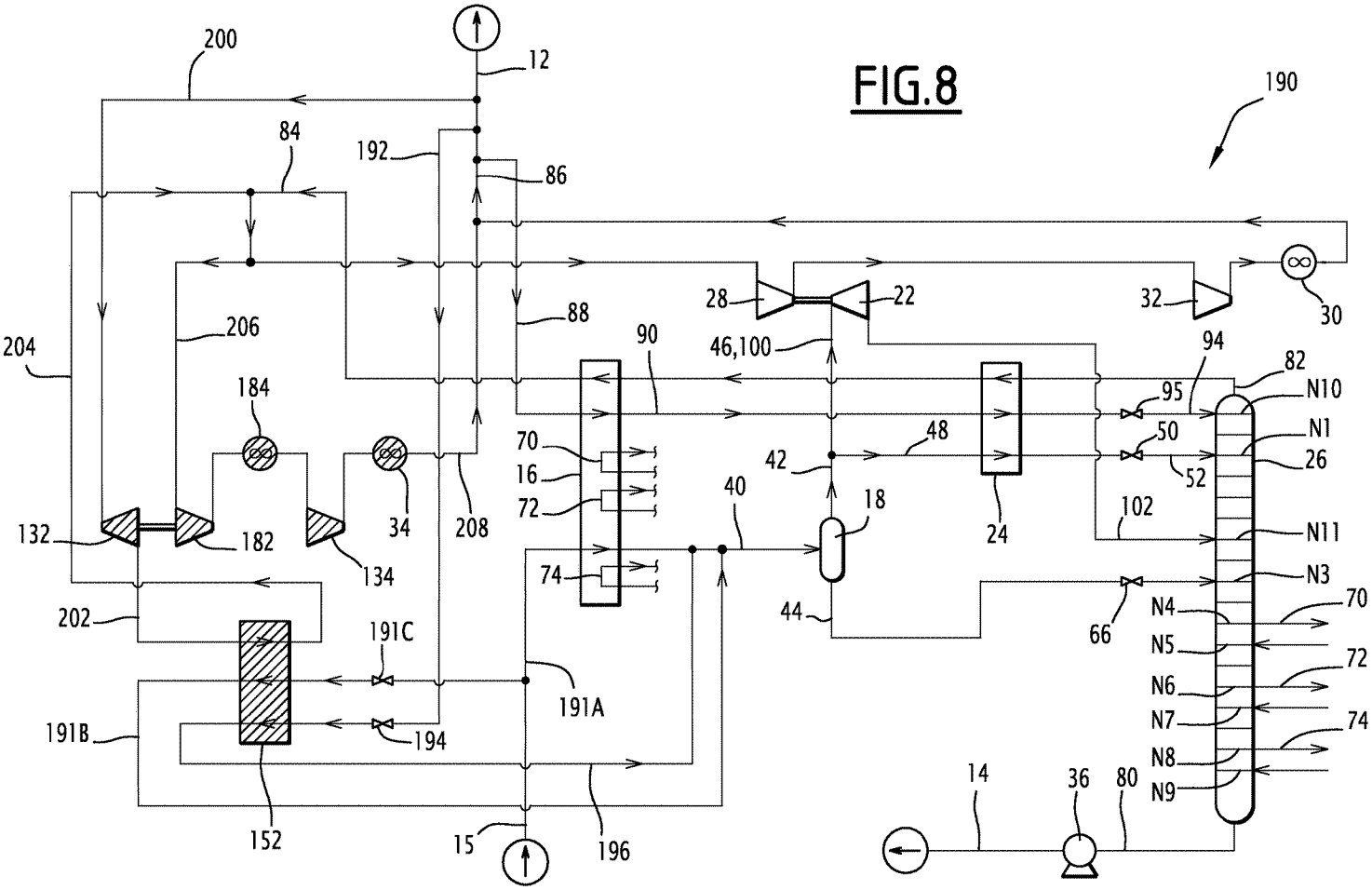
FIG. 8 is a view similar to FIG. 1 of a seventh facility according to the invention, for applying a seventh method according to the invention.

A seventh facility 190 according to the invention is illustrated in FIG. 8. This seventh facility is intended for applying a seventh method according to the invention.

The seventh facility 190 differs from the second facility 110 by the power of a third heat exchanger 152, by the presence of a third compressor 134 and of a second air cooler 34, and by the presence of a fourth compressor 182 coupled with a third air cooler 184. Further, the fourth compressor 182 is coupled with a second expansion turbine 132.

The seventh method according to the invention differs from the second method according to the invention in that the second recirculation stream is formed by a sampling fraction 192 taken in the compressed methane-rich head stream 86, downstream from the sampling of the first recirculation stream 88.

The sampling fraction 192 is then conveyed as far as the third heat exchanger 152, after passing into a valve 194 for forming an expanded cooled sampling fraction 196. This fraction 196 has a pressure of less than 63 bars and a temperature below 40° C.

The flow rate of the sampling fraction 192 is less than 1% of the flow rate of the stream 82 taken at the outlet of the column 26.

The feed natural-gas stream 15 is separated into a first feed flow 191A conveyed as far as the first heat exchanger 16 and into a second feed flow 191B conveyed as far as the third heat exchanger 152, by flow rate control with the valve 191C. The feed flows 191A, 191B, after their cooling in the respective exchangers 16, 152, are mixed together at the outlet of the respective exchangers 16 and 152 in order to form the cooled feed natural gas flow 40 before its introduction into the separator flask 18.

The ratio of the flow rate of the feed flow 191A to the flow rate of the feed flow 191B is comprised between 0 and 0.5.

The sampled fraction 196 is introduced into the first feed flow 191A at the outlet of the first exchanger 16 before its mixing with the second feed flow 191B.

A secondary cooling stream 200 is sampled in the compressed methane-rich head stream 86, downstream from the sampling of the sampling fraction 192.

This secondary cooling stream 200 is transferred as far as the dynamic expansion turbine 132 so as to be expanded down to a pressure below the pressure of the column 26 and to provide frigories. The expanded secondary cooling stream 202 from the turbine 132 is then introduced, at a temperature below 40° C. into the third exchanger 152 in order to be heated up by heat exchange with the flows 191B and 192 up to substantially room temperature.

Next, the heated-up secondary cooling stream 204 is reintroduced into the methane-rich head stream 84 at the outlet of the third exchanger 16, before passing into the first compressor 28.

Further, a recompression fraction 206 is sampled in the heated-up methane-rich head stream 84 downstream from the introduction of the heated-up secondary cooling stream 204, and is then successively passed into the fourth compressor 182, into the third air cooler 184, into the third compressor 134, and then into the second air cooler 34. This fraction 208 is then reintroduced into the compressed methane-rich head stream 86 from the second compressor 32, upstream from the sampling of the first recirculation stream 88.

The compressed methane-rich stream 86 from the cooler 30 and receiving the fraction 208 is advantageously at room temperature.

The seventh method according to the invention gives the possibility of keeping the compressor 32 and the turbine 22 identical when the ethane content and those of $C_3^+$ hydrocarbons in the feed gas increase, while obtaining a recovery of ethane of more than 99%.

Further, the yield of this method is improved as compared with that of the sixth method according to the invention, for constant $C_2^+$ hydrocarbon content. This is all the more true since the $C_2^+$ hydrocarbon content in the feed gas is significant.

In an alternative (not shown), the light fraction 42 from the separator flask 18 is not divided. The totality of this fraction then forms the turbine input flow 46, which is sent towards the first dynamic expansion turbine 22.

What is claimed is:

1. A method for producing a methane-rich stream and a $C_2^+$ hydrocarbon-rich fraction from a dehydrated feed natural-gas stream, consisting of hydrocarbons, nitrogen and of $CO_2$, having a $C_2^+$ hydrocarbon molar content of more than 10%, the method comprising the following steps:

cooling the feed natural-gas stream at a pressure of more than 40 bars in a first heat exchanger, and introducing the cooled feed natural-gas stream into a separator flask;

separating the cooled natural gas stream in the separator flask and recovering a gaseous light fraction and a liquid heavy fraction;

forming a turbine input flow from the light fraction;

dynamically expanding the turbine input flow in a first expansion turbine, and introducing the expanded flow into an intermediate portion of a splitter column;

expanding the heavy fraction and introducing the heavy fraction into the splitter column, the heavy fraction recovered in the separator flask being introduced into the splitter column without passing through the first heat exchanger;

recovering, at the foot of the splitter column, a $C_2^+$ hydrocarbon-rich bottom stream intended to form the $C_2^+$ hydrocarbon-rich fraction;

taking at the head of the splitter column a methane-rich head stream;

heating up the methane-rich head stream in a second heat exchanger and in the first heat exchanger to form a heated methane-rich head stream and compressing the heated methane-rich head stream in at least one first compressor coupled with the first expansion turbine and in a second compressor in order to form a compressed methane-rich head stream, the methane-rich stream being formed from the compressed methane-rich head stream;

taking from the methane-rich head stream a first recirculation stream;

passing the first recirculation stream into the first heat exchanger and into the second heat exchanger in order to cool it down, and then introducing at least one first portion of the cooled recirculation stream into the upper portion of the splitter column;

the method comprising the following steps:

forming at least one second recirculation stream obtained from the methane-rich head stream downstream from the splitter column;

forming a dynamic expansion stream from the second recirculation stream and introducing the dynamic expansion stream into the first dynamic expansion turbine in order to produce frigories; and introducing the frigories into the separation column.

2. The method according to claim 1, wherein the formation of the turbine input flow includes a division of the light fraction into the turbine input flow and into a secondary flow, the method comprising cooling of the secondary flow in the second heat exchanger and introducing the cooled secondary flow into an upper portion of the splitter column.

3. The method according to claim 1, wherein the second recirculation stream is introduced at a location downstream from the first heat exchanger and upstream from the first expansion turbine in order to form the dynamic expansion stream.

4. The method according to claim 3, wherein the second recirculation stream is mixed with the turbine input flow obtained from the separator flask in order to form the dynamic expansion stream that is received by the first expansion turbine.

5. The method according to claim 3, wherein the second recirculation stream is taken from the first recirculation stream.

6. The method according to claim 3, further comprising the following steps:

taking a sampling stream from the methane-rich head stream, before the passing of the methane-rich head stream into the first compressor and into the second compressor;

compressing the sampling stream in a third compressor;

forming the second recirculation stream from the compressed sampling stream stemming from the third compressor, after cooling.

7. The method according to claim 6, further comprising passing of the sampling stream into a third heat exchanger and into a fourth heat exchanger before the introduction of the sampling stream into the third compressor, and then the passing of the compressed sampling stream into the fourth heat exchanger, and then into the third heat exchanger in order to feed the head of the splitter column, the second recirculation stream being taken from the cooled compressed sampling stream, between the fourth heat exchanger and the third heat exchanger.

8. The method according to claim 6, wherein the sampling stream is introduced into a fourth compressor, the method comprising the following steps:

taking a secondary diversion stream from the cooled compressed sampling stream from the third compressor and from the fourth compressor;

dynamically expanding the secondary diversion stream in a second expansion turbine coupled with the fourth compressor;

introducing the expanded secondary diversion stream into the sampling stream before the passing of the sampling stream into the third compressor and into the fourth compressor.

* * * * *